United States Patent [19]

Smith et al.

[11] 3,986,757

[45] Oct. 19, 1976

[54] REFUSE COMPACTOR BAG STORAGE MEANS

[75] Inventors: Erwin G. Smith; Charles E. Sulcek, both of Danville, Ky.

[73] Assignee: Whirlpool Corporation, Benton Harbor, Mich.

[22] Filed: Apr. 21, 1975

[21] Appl. No.: 569,987

[52] U.S. Cl. ..... 312/223; 312/211; 100/229 A

[51] Int. Cl.[2] ..... A63B 55/14; B30B 15/30

[58] Field of Search ..... 312/211, 212, 214, 223, 312/290; 100/45, 73, 229 A; 232/43.2, 43.3, 43.4

[56] References Cited

UNITED STATES PATENTS

| | | | |
|---|---|---|---|
| 2,916,183 | 12/1959 | Ariens | 312/211 |
| 3,859,911 | 1/1975 | Karls et al. | 232/43.2 |
| 3,872,342 | 3/1975 | Dankert | 312/212 |

*Primary Examiner*—Casmir A. Nunberg

*Attorney, Agent, or Firm*—Wegner, Stellman, McCord, Wiles & Wood

[57] ABSTRACT

A refuse compactor structure having an improved arrangement for storing bags to be used in containing the refuse during the compacting operation. The compactor structure utilizes a cover panel for electrically isolating and covering electrical apparatus in an apparatus space within the compactor which further defines a portion of the bag holding structure. The cover panel may be removably carried in the cabinet.

9 Claims, 7 Drawing Figures

REFUSE COMPACTOR BAG STORAGE MEANS

BACKGROUND OF THE INVENTION

1. Field of the Invention

This invention relates to refuse compactors and in particular to the electrical isolation of electrical apparatus in such refuse compactors and the storage of refuse holding bags within the compactor cabinet.

2. Description of the Prior Art

In United States Letters Pat. No. 3,805,691 of Charles E. Sulcek, and owned by the assignee hereof, a refuse compactor with compacting bag storage means is disclosed as including means within an upper rear portion of the cabinet for storing the refuse holding bags. In the Sulcek compactor structure, the bag holder comprises a housing which is supported from the top wall of the cabinet. Access is provided to the interior of the housing through an opening in the cabinet top wall and as disclosed in said patent, the housing may be formed of moisture-resistant material.

The frame and cabinet structure for the refuse compactor may define a rear, lower electrical apparatus space for housing the electrical drive motor and associated controls. Mounting of the drive motor apparatus in such space is illustrated in United States Letters Pat. No. 3,786,744, of Frank E. Miller et al, which patent is also owned by the assignee hereof. As shown in the Miller et al patent, the compactor may be provided with a vertical divider wall disposed forwardly of the rear wall of the cabinet and defining the forward wall of the electrical apparatus space.

The use of bag holding means in bagging and check-out counter systems is conventional. Further, it is known to provide, in refuse compactors, bag storage means above the drawer space.

SUMMARY OF THE INVENTION

The present invention comprehends an improved refuse compactor structure wherein panel means are provided within the cabinet to isolate the electrical apparatus space and further define means for supporting refuse bags within the cabinet in preselected disposition adjacent an access opening in the cabinet.

More specifically, the invention comprehends providing such a refuse compactor panel means which is spaced below an opening in the top wall of the refuse compactor cabinet for supporting the bags in alignment with the top opening.

The panel may be removably supported in the cabinet, and more specifically, may be supported on the divider wall and/or rear wall of the cabinet.

The divider wall may have an irregular horizontal cross section and the panel may have a front edge defining a similar configuration so as to permit full upward closure of the electrical apparatus space.

The top wall of the cabinet may be provided with depending flange means adjacent the opening for laterally supporting the upper portion of the stored bags resting on the support panel in a vertically flatwise configuration.

The panel means may comprise a metal panel for effective electrical isolation of the apparatus space in cooperation with the divider and outer walls of the cabinet.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3, 4, 5, 6, 7:
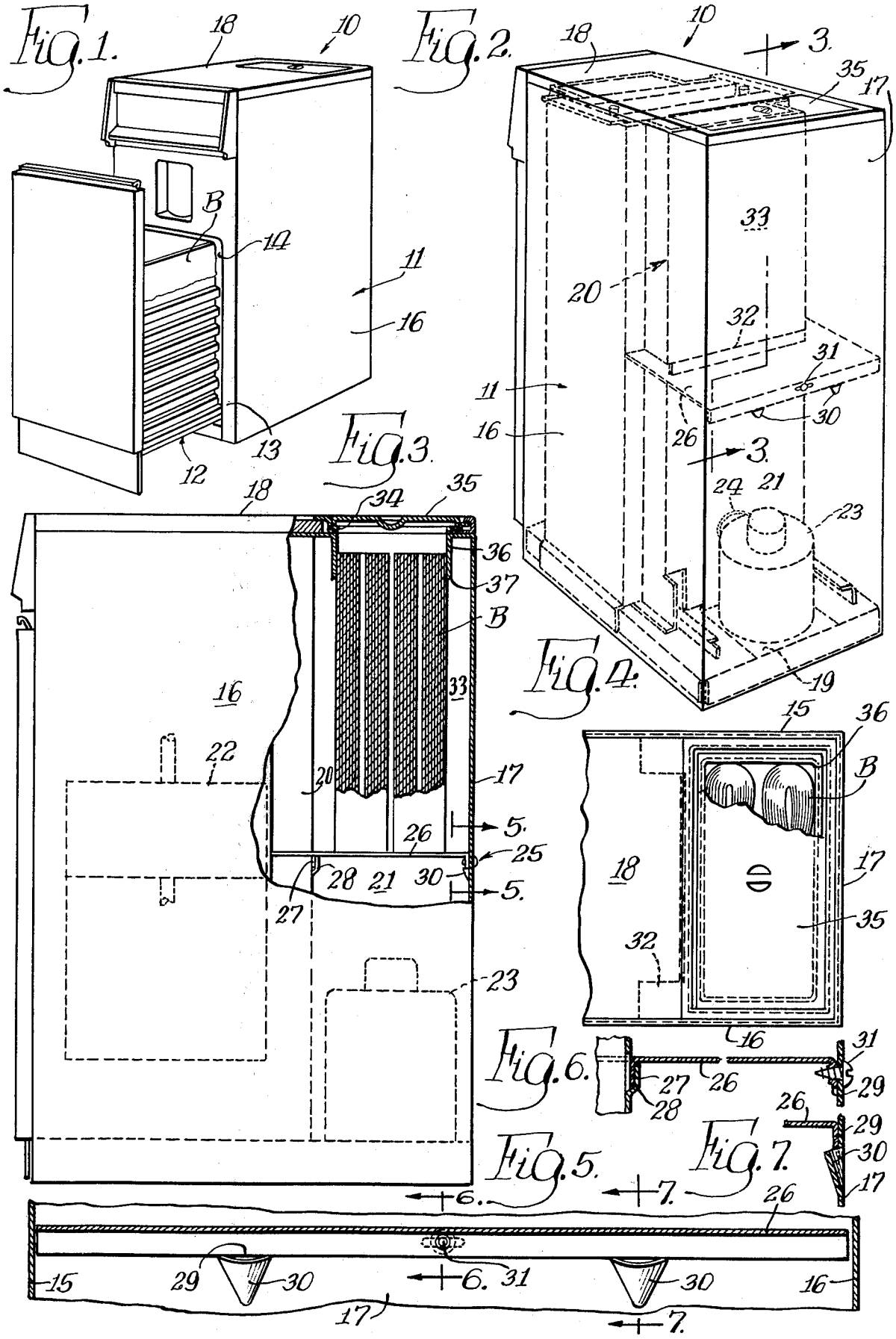
FIG. 1 is a perspective view of a refuse compactor structure embodying the invention.
FIG. 2 is a rear perspective view with a portion of the internal structure thereof shown in dotted lines.
FIG. 3 is a right side elevation with a portion broken away to illustrate the arrangement of the bag holding means.
FIG. 4 is a fragmentary top plan view with a portion broken away to illustrate the bag holding means.
FIG. 5 is a fragmentary vertical section taken substantially along the line 5—5 of FIG. 3.
FIG. 6 is a fragmentary vertical section taken substantially along the line 6—6 of FIG. 5.
FIG. 7 is a fragmentary vertical section taken substantially along the line 7—7 of FIG. 5.

In the exemplary embodiment of the invention as disclosed in the drawing, a refuse compactor generally designated 10 is shown to include an outer cabinet 11 and a refuse holding receptacle 12. In the illustrated embodiment, cabinet 11 defines a front wall 13 having an opening 14 through which receptacle 12, illustratively comprising a drawer-type receptacle, is selectively movable between an inner, compacting position within the cabinet and an outer, exposed position outwardly of the cabinet, as illustrated in FIG. 1.

The cabinet further includes a left side wall 15, a right side wall 16, a rear wall 17, a top wall 18 and a bottom wall 19 cooperatively defining a generally parallelpiped configuration. A vertical divider wall 20 extends upwardly from bottom wall 19 to top wall 18 forwadly of rear wall 17, as best seen in FIG. 2, to define an electrical apparatus space 21 in the lower rear portion of the cabinet.

Refuse placed in drawer 12 is compacted therein by means of a ram 22 in the forward portion of the cabinet. The ram is selectively lowered and raised in the compacting cycle by a suitable drive means including an electrical drive motor 23 provided with suitable electrical wiring 24 which is disposed in space 21 rearwardly of the divider wall.

The present invention comprehends the provision of panel means generally designated 25 for effectively upwardly, electrically isolating space 21 so as to avoid the need for separate covers for motor 23 and wiring 24, thereby substantially reducing the cost of the electrical apparatus while yet permitting the compactor construction to meet all requirements of the Underwriters Laboratories. As shown, panel means 25 includes a rigid panel 26 which, in the illustrated embodiment, is formed of metal. Panel 26 includes downturned male portions 27 adapted to be received in suitable lanced female portions 28 struck in the divider wall 20, and further includes a downturned portion 29 resting on dimples 30 struck in rear wall 17. Downturned portion 29 comprises a rear flange which may be removably secured to rear wall 17 by a suitable sheet metal screw 31, as illustrated in FIG. 6.

As shown in FIG. 2, divider wall 20 defines an irregular horizontal cross section and panel 26 defines a front edge 32 having a similar configuration so that panel 26 effectively fully closes the top of space 21 to effect the desired isolation of the electrical apparatus space.

As indicated briefly above, panel 26 synergistically further defines a portion of the means for storing bags B in cabinet 11 for subsequent use in lining the drawer 12, as illustrated in FIG. 1. As shown in FIG. 3, the bags may be stored in an upper rear storage space 33 within the cabinet rearwardly of the divider wall 20 and above panel 26. The location of lanced portions 28 and dimples 30 is preselected to permit storage of the bags B in folded flat arrangement so as to extend flatwise vertically upwardly from panel 26 to subjacent an opening 34 in top wall 18 for providing access to space 33 in placement in and removal from the space of the refuse holding bags. As shown, opening 34 may be selectively closed by a lid 35. A flange member 36 is supported on top wall 18 to depend therefrom and circumscribe opening 34. Thus, as shown in FIG. 3, the flange 36 retains the upper edges of the bags B against lateral displacement and maintains them in alignment with the opening for facilitated withdrawal. The length of the flange 36 is preselected so as to cause the lower edge 37 thereof to be spaced above the panel 26 a distance less than the flatwise height of the bags to assure that the bags do not slip under the flange but are, as discussed above, maintained in alignment with the access opening.

Thus, the invention comprehends an improved refuse compactor structure wherein both the conventional motor and wiring covers are eliminated and the need for a housing for receiving the stored bags within the outer cabinet is eliminated. In lieu thereof, a simple low cost metal panel is removably secured between the divider wall and rear wall of the cabinet which synergistically provides both the electrical isolation and bag supporting means.

The foregoing disclosure of specific embodiments is illustrative of the broad inventive concepts comprehended by the invention.

Having described the invention, the embodiments of the invention in which an exclusive property or privilege is claimed are defined as follows:

1. In a refuse compactor having a cabinet defining a top wall having an opening, a rear wall, and wall means cooperating with said rear wall to define an electrical apparatus space, an improved means for storing bags for use in holding refuse to be compacted in the compactor, said improved means comprising a panel supported by said rear wall and said wall means to extend therebetween horizontally above said electrical apparatus space and isolate said space electrically, said panel being spaced a preselected distance below said opening for supporting a plurality of bags in said cabinet in alignment with said opening for facilitated selective removal of the bags as desired.

2. The refuse compactor structure of claim 1 wherein said panel is removably supported by said rear wall.

3. The refuse compactor structure of claim 1 wherein said panel is removably supported by said wall means.

4. The refuse compactor structure of claim 1 wherein said wall means includes a vertical divider wall forwardly of said rear wall, and support means on said divider wall for carrying a forward edge portion of said panel, said divider wall defining an irregular horizontal cross section and said panel rear edge portion being complementarily irregular for cooperation with said divider wall in fully upwardly closing said electrical apparatus space.

5. The refuse compactor structure of claim 1 wherein said panel comprises a metal panel.

6. The refuse compactor structure of claim 1 wherein said panel comprises a flat panel overlying the entire said electrical apparatus space.

7. The refuse compactor structure of claim 1 wherein said cover means comprises a rigid panel.

8. In a refuse compactor having a cabinet defining a top wall having an opening, a rear wall, and wall means cooperating with said rear wall to define an electrical apparatus space, an improved means for storing bags for use in holding refuse to be compacted in the compactor, said improved means comprising a panel supported by said wall means to extend above said electrical apparatus space and isolate said space electrically, said panel being spaced a preselected distance below said opening for supporting a plurality of bags in said cabinet in alignment with said opening for facilitated selective removal of the bags as desired, said wall means including a vertical divider wall forwardly of said rear wall, and support means on said divider wall for carrying a forward edge portion of said panel, said support means comprising a female securing means, said panel rear edge portion being provided with male securing means for cooperation with said female securing means to support said panel on said divider wall.

9. In a refuse compactor having a cabinet defining a top wall having an opening, a rear wall, and wall means cooperating with said rear wall to define an electrical apparatus space, an improved means for storing bags for use in holding refuse to be compacted in the compactor, said improved means comprising: a panel supported by said wall means to extend above said electrical apparatus space and isolate said space electrically, said panel being spaced a preselected distance below said opening for supporting a plurality of bags in said cabinet in alignment with said opening for facilitated selective removal of the bags as desired; and flange means carried by said top wall projecting downwardly adjacent said opening a preselected distance to define a lower edge portion spaced above said panel a distance less than the flatwise dimension of said bags whereby said bags may be stored with a lower edge portion resting on said panel and an upper edge portion maintained in alignment with said opening laterally of said flange means.

* * * * *